US005886286A

United States Patent [19]

Will et al.

[11] Patent Number: 5,886,286

[45] Date of Patent: Mar. 23, 1999

[54] MONITORING SAFETY SYSTEM

[75] Inventors: Albert S. Will, Bethesda; Robert R. Wilson, Chillum, both of Md.

[73] Assignee: The United States of America as represented by the Secretary of the Navy, Washington, D.C.

[21] Appl. No.: 475,024

[22] Filed: Jul. 26, 1965

[51] Int. Cl.[6] ..... F42C 15/44

[52] U.S. Cl. ..... 102/216; 244/3.2

[58] Field of Search ..... 102/70.2, 76, 83, 102/206, 215, 216; 244/3.2

[56] References Cited

U.S. PATENT DOCUMENTS

| | | | |
|---|---|---|---|
| 2,940,392 | 6/1960 | Loren et al. | 102/206 |
| 2,949,855 | 8/1960 | Saunderson | 102/216 |
| 2,952,208 | 9/1960 | Wagoner | 102/216 |
| 2,978,961 | 4/1961 | Ruehlemann et al. | 102/216 |
| 2,980,020 | 4/1961 | Smith | 102/216 |
| 3,098,448 | 7/1963 | Gisser et al. | 102/276 |
| 3,153,520 | 10/1964 | Morris | 102/215 |
| 3,218,470 | 11/1965 | Padgett et al. | 326/135 |

*Primary Examiner*—Charles T. Jordan
*Assistant Examiner*—Christopher K. Montgomery

[57] ABSTRACT

A guidance monitoring safety system for a guided missile having platform gyros and electromechanical integrators with inputs from a guidance information analyzer. The system monitors malfunctions resulting from erratic or unsafe missile flight either dudding the missile if any malfunctions are present or providing a safe-to-arm fuzing signal in the absence of malfunctions.

10 Claims, 1 Drawing Sheet

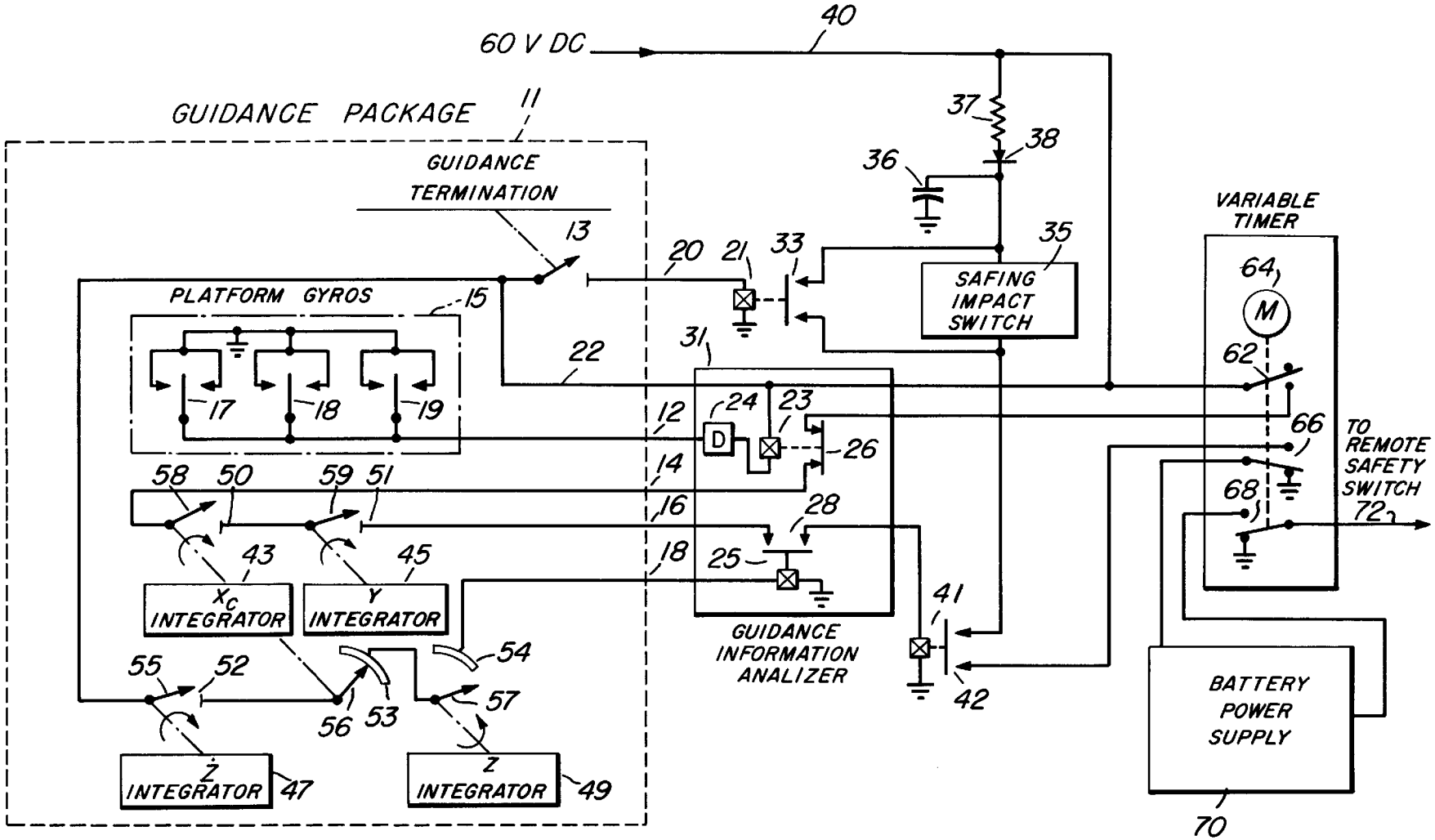
TO REMOTE SAFETY SWITCH
72
VARIABLE TIMER
64
M
62
66
68
BATTERY POWER SUPPLY
70
38
35
SAFING IMPACT SWITCH
37
36
41
42
40
26
28
GUIDANCE INFORMATION ANALIZER
33
23
24
D
25
21
31
20
12
14
16
18
60 V DC
11
GUIDANCE PACKAGE
GUIDANCE TERMINATION
13
22
15
PLATFORM GYROS
19
18
17
49
Z INTEGRATOR
54
57
45
Y INTEGRATOR
51
59
53
56
43
$X_c$ INTEGRATOR
50
58
52
47
Z INTEGRATOR
55

MONITORING SAFETY SYSTEM

The invention described herein may be manufactured and used by or for the Government of the United States of America for governmental purposes without the payment of any royalties thereon or therefor.

This invention relates to a guided missile safety system and more particularly to a guidance monitoring safety system which monitors malfunctions which would result in erratic or unsafe flight of the missile, either dudding the missile if any of the malfunctions are present or providing a safe-to-arm fuzing signal if none of the malfunctions are present.

The invention to which the present application is directed was developed as part of the SUBROC Weapon System although it will be clear from the detailed description to follow that it may be employed with any ordinary missile using an inertial guidance system. The SUBROC missile is an anti-submarine weapon provided with a nuclear warhead and designed to be launched from a torpedo tube of an attack submarine, thereafter to emerge from the water and go through an air boost phase depending upon the selected range, during which it is directed to the target area by the guidance system, and then to reenter the water at the target. More specifically the present invention was developed for the SUBROC weapon adaption kit (A/K), disclosed in Ser. No. 545,792 filed Apr. 21, 1966, now U.S. Pat. No. 3,411,559, to prevent the warhead from receiving the signal necessary to arm and fire it until the missile had been launched and had traversed its proper trajectory to the target area. The A/K functions to arm the system with a high degree of reliability at the appropriate time after the weapon has reached a safe distance and provides a signal to the nuclear warhead to fire it with a nuclear yield upon reaching a predetermined depth after water reentry.

In missile guidance systems, a problem arises in providing safety assurance that the missile will be dudded when the guidance system malfunctions. Using the SUBROC missile, for which the subject safety system was concerned, as an example, if the missile has an altitude apogee which is less than the predetermined minimum altitude which is sufficient to permit it to fly to the desired range, the missile will fall short of the target. If at apogee, the guidance package computed distance to the target is not greater than a predetermined calculated minimum, the combined output from the guidance accelerometers and integrators may have excessively high outputs which would result in the missile diving in short of the target. At some time just prior to the missile reaching the timer arm zone, the distance $X_c$ (range along the canted coordinate) should decrease nearly to zero on a normal trajectory. For a scalar $X_c$ too great at this point, the trajectory is abnormal and will either undershoot or overshoot the target. Also when the missile is off course in the azimuth direction or becomes erratic due to gyro tumble, the missile will probably be on a dangerous trajectory and should be dudded.

In the past fuzing systems have incorporated self destruction systems which are actuated by some abnormal flight condition, or they have been made harmless by using special condition responsive circuitry which permit the missile to be armed only after a predetermined sequence of operations. One such system provides two separate energy sources for circuits within the missile fuzing system and two impact switches operated according to deceleration producing conditions prevailing outside the missile. A plurality of firing trains are activated in a predetermined manner according to the prevailing conditions. Another known system provides a plurality of integrators in two missile guidance packages for generating firing and arming information to the missile. These systems while providing safety measures are relatively complex and have not proven satisfactory for the SUBROC missile. This invention provides a guidance monitoring safing system which embraces all the advantages of similarly employed guided missile safety devices and possess none of the afore described disadvantages. This is accomplished by monitoring the guidance portion of the missile system directly through wafer switches attached to the guidance integrator shafts. After appropriate signals are received from guidance in a predetermined sequence showing that the missile is on its trajectory, the guidance monitoring safety system supplies a safe-to-arm signal to the A/K.

Accordingly, it is an object to provide a guided missile fuzing system which is fail-safe for the SUBROC missile.

Another object is the provision of a guidance monitoring safety device which is self triggering, which continually monitors interrelated functions of the guidance portion of a missile fuzing system and provides a safe-to-arm signal to a remote switch in the arming circuitry of a fuzing system when the missile has not behaved erratically and has remained on its trajectory path.

Another object is to provide a guided missile safety system which depends on salient trajectory conditions, which does not require an additional guidance package for comparision with the first for generation of safety signals, and which reduces the complexity of the SUBROC missile fuzing system without reducing its safety features.

A still further object is to provide a guidance monitoring safety system compatible with a SUBROC missile which will dud the missile if the missile does not reach a predetermined apogee, if the missile is off the trajectory path by a predetermined amount, if the guidance information analyzer does not receive predetermined signals from guidance in a proper sequence, or if the missile is behaving erratically.

These and other objects of the invention will become apparent to those skilled in the art as the disclosure is made in the following description of one embodiment of the invention as illustrated in the accompanying sheet of drawings in which:

The FIGURE illustrates a circuit diagram of a guidance monitoring safety system.

Guidance conditions are monitored over channels 12, 16 and 18 which connect guidance package 11 with guidance information analyzer 31. Guidance package 11 contains platform gyros 15, $X_c$ integrator 43, Y integrator 45, Z integrator 49, and Z integrator 47. The integrator circuits are known to those skilled in the art and may be of the type described by H. D. Saunderson, U.S. Pat. No. 2,949,855 issued Aug. 23, 1960 or B. J. Wagoner, U.S. Pat. No. 2,952,208 issued Sep. 13, 1960. The SUBROC guidance system uses electromechanical integrators which can be monitored directly through wafer switches attached to the integrator shafts.

The first condition under which the missile should be dudded by action of the guidance system is at the time when $\dot{Z}$=o (apogee), if Z is less than some predetermined constant K1. Integrator 47 rotates contact 55 to position 52 at which $\dot{Z}$=o. At this time for all normal trajectories Z, the altitude of the missile, must be greater than some minimum altitude K1 which is sufficient to permit it to fly to the minimum desired range. K1 is determined from final trajectory calculations based on final missile ballistic constants and is of such value that missiles with less altitude at apogee cannot reach the target. For the SUBROC missile this value is approximately 8000 feet which is represented by contact slot length 54 in channel 18.

Also at the time $\dot{Z}$ integrator 47 is in the $\dot{Z}=0$ position, which corresponds to initiation by guidance of pitch guidance, the value of $X_c$ should be greater than a minimum K2 which is determined from trajectory calculations based on final missile ballistic constants for the shortest desired range. A measurement that $X_c$ is greater than the stated minimum insures that the combined output from the guidance $X_c$ and/or Z accelerometers and integrators is not in error by excessively high outputs which would cause $X_c$ to decrease abnormally fast and result in the missile diving in short of the target. Slot 53 of wafer switch 56 on $X_c$ integrator represents the value of the constant K2.

A 60 volt power supply is normally supplied over lead 40 to the Guidance Information Analyzer (GIA) 31 and Guidance 11. When contact 55 is closed and contacts 56 and 57 are within the ranges of slots 53 and 54, a signal is supplied over channel 18 to explosive switch 25 closing contacts 28 in channel 16.

As the missile approaches the target range, $X_c$ should have decreased nearly to zero on normal trajectory. If $X_c$ is greater than some small constant K3 at this time, either from abnormally low output from the X and/or Z accelerometers and/or associated integrators, or resulting from failure in the autopilot (not shown), the trajectory is abnormal and the missile should be dudded. At this time which may be approximately 5 seconds before the arm zone as initially set into the variable time by fire control, the variable timer motor 64 moves contact 62 into a closed position. If the $X_c$ integrator 43 has moved switch 58 into position 50 and Y integrator 45 has moved switch 59 into position 51 at the time when switch 62 is closed and after explosive switch 25 has closed contacts 28, a 60 volt supply signal will be supplied to explosive switch 41 over channel 16 to close contacts 42. Slot 51 represents a safe distance in the azimuth direction which may be about 1–1½ miles for the SUBROC missile, and slot 50 represents a safe distance in range of about 1 mile.

Variable timer switchs 66 and 68 close at the fire control preset time, completing a circuit through battery power supply 70 if explosive switch 41 has closed contacts 42 prior to this time. If contacts 42 are closed and either safing impact switch 35 or contacts 33 are closed due to explosive switch 21 receiving a guidance termination signal over lead 20, a signal is supplied over lead 40 through resistor 37 and diode 38 to initiate the battery power supply which in turn provides output power on lead 72 to provide power for further A/K arming and firing functions.

Still another condition in the guidance system which indicates that the missile should be dudded is available when the platform gyros are not able to maintain their spacial reference. When this happens, a gyro movable contact, such as contacts 17, 18 and 19, hits a limit contact indicating gyro tumble from which it is known that the flight of the missile has become erratic and the missile should be dudded. For any platform gyro tumble greater than 2 milliseconds, provided by a suitable delay circuit such as an RC circuit 24 explosive switch 23 will operate opening contacts 26 and preventing a safe-to-arm signal from occurring over channel 16 to explosive switch 41. The time delay would permit a missile, which recovered in less than 2 milliseconds and flew normally thereafter to the target area, to arm and fire.

As described above the indicated constants (K1 through K4) are represented by the length of the wafer switch contacts in the electromechanical integrators in the guidance package. The variable timer contacts operate in response to angular positions of the shaft driven by a motor. With this arrangement mechanical switch closures can be obtained directly from existing electromechanical integrators by addition of suitable rotary switch wafers.

The guidance information analyzer is shown as two explosive switches for the sake of illustrative purposes but it is well within the scope of the invention to replace the explosive switches by solid state devices such that signals from guidance need only trigger the GIA circuitry to apply power via the GIA to provide a safe-to-arm signal. A suitable solid state GIA is disclosed in copending application, Ser. No. 459,131 filed May 26, 1965.

From the foregoing it is apparent that a guidance monitoring safety system for a guided missile weapon fuzing system has been developed which is fail-safe, since failure of any component prevents generation of a safe-to-arm signal; which provides a safe-to-arm signal when the missile has remained on trajectory and has not behaved erratically; but which will dud the missile if predetermined conditions are not fulfilled.

Obviously many modifications and variations of the present invention are possible in the light of the above teachings. It is therefore to be understood, that within the scope of the appended claims, the invention may be practiced otherwise than as specifically described.

What is claimed and is desired to be secured by letters patent of the United States is:

1. In a guided missile fuzing system;

a plurality of guidance integrators having rotating shafts and a plurality of platform gyros, one of said integrators indicating when the missile is at apogee, another of said integrators indicating the altitude of said missile, yet another of said integrators indicating the range along the canted coordinate of said missile, and still another of said integrators indicating the missile deviation in the azimuth direction, electromechanical wafer switches connected to each of said integrators for monitoring guidance conditions, and gyro tumble switches connected to said gyros for monitoring additional guidance conditions;

an apogee monitoring channel output, a prior-to-arming monitoring channel output, and a gyro tumble channel output;

a guidance information analyzer connected to said channels, having a first gate in said apogee channel and a second gate in said gyro tumble channel, said first gate operable to close an electrical path in said prior-to-arm channel when an apogee monitoring signal is received, said apogee monitoring signal being sent only when any of three wafer switches, connected one to each of said apogee, range, and altitude integrator shafts, are closed completing a path for a signal on said apogee channel, said second gate operable to open an electrical path in said prior-to-arm channel when one of the gyro tumble switches closes, said prior-to-arming channel supplying a safe-to-arm output signal from said guidance information analyzer when two additional wafer switches, connected one to each of said range and azimuth integrators, are closed, an apogee monitoring signal has been received, and a gyro tumble monitor signal has not been received.

2. The apparatus of claim 1 further comprising a variable timer connected to said guidance information analyzer having a plurality of electromechanical timing switches actuable to connect the safe-to-arm signal source to an arming and firing section of said guided missile at a predetermined time, a battery power supply connected to said timer means, a first of said timing switches operable to time just prior to the missile reaching the arming zone for completing a signal path in said prior-to-arm channel, a second and third of said arming switches operable at the time the weapon is in the arming zone for connecting the battery power supply to the arming section of said missile, a third gate in said prior-to-arm channel responsive to said safe-to-arm signal from the guidance information analyzer for completing a battery power supply path to said arming section of the missile.

3. A guidance monitoring safing apparatus for a guided missile fuzing system, comprising;

an electromechanical guidance monitor for detecting guidance conditions of said guided weapon, said monitor having a plurality of output channels;

a guidance information analyzer connected to said output channels responsive to monitoring signals over said channels in a predetermined sequence to supply a safe-to-arm signal output, and;

an altitude monitoring means in said monitor connected to a first one of said channels for partially enabling a first monitoring signal over said first channel if said missile has reached a predetermined altitude at apogee, and for preventing a monitoring signal on said first channel if said first missile has not reached a predetermined altitude at apogee, and range monitoring means connected to said first channel for partially enabling a first monitoring signal over said first channel if said first missile has reached a predetermined range at apogee, and for preventing a monitoring signal on said first channel if said missile has not reached a range greater than said predetermined range at apogee;

whereby a first monitoring signal is sent to the guidance information analyzer at the time of weapon apogee only if the weapon has an altitude and range sufficient to carry it to its target.

4. The apparatus of claim 3 further comprising range and azimuth monitoring means connected to a second channel in said monitor for enabling a second monitoring signal over said second channel a predetermined time just prior to the missile reaching the arming zone only if said missile range and azimuth deviations from a normal trajectory path are less than first and second predetermined deviations respectively, said range and azimuth monitoring means preventing a second monitoring signal if either of said deviations are greater than their respective predetermined deviations, whereby a second monitoring signal is sent to the guidance information analyzer at a time just prior to the weapon arming zone only if the weapon has not deviated more than a safe distance from its trajectory path.

5. The apparatus of claim 4 wherein said range and azimuth monitoring means are electromechanical wafer switches.

6. The apparatus of claim 4 further comprising;

gyro tumble monitoring means connected to a third channel in said monitor for enabling a third monitoring signal over said third channel, a time delay circuit in said third channel providing a predetermined short duration delay to signals resulting from gyro contact brushing, a first gate in said guidance information analyzer responsive to said first monitoring signal for closing said second channel, and a second gate in said guidance information analyzer included in said third channel responsive to monitoring signals having a duration greater than said predetermined delay on said third channel for opening said second channel.

7. The apparatus of claim 6 wherein said gates are explosive switches.

8. The apparatus of claim 6 wherein said gates are solid state devices.

9. The apparatus of claim 3 wherein said range monitoring means are electromechanical wafer switches.

10. In a guided missile arming and firing system, a guidance monitoring safety device, comprising;

means for monitoring the guidance of said weapon having a plurality of guidance condition output channels;

a guidance information analyzer connected to said monitoring means by said output channels responsive to receiving a plurality of guidance signals over said channels in a predetermined sequence for supplying a safe-to-arm output signal, timer means connected to said guidance information analyzer having a plurality of timing switches actuable to connect a safe-to-arm signal source to an arming section of said guided missile at a predetermined time;

said monitoring means having a plurality of platform gyro tumble switches responsive when actuated to send a signal over one of said channels to said guidance information analyzer, and gating means in said guidance information analyzer responsive to a gyro tumble signal for blocking another of said channels, thereby preventing a safe-to-arm signal output, whereby a safe-to-arm signal is prevented unless said monitoring means supplies guidance condition signals to said guidance information analyzer in a predetermined sequence before said predetermined time.

* * * * *